US008483421B2

(12) United States Patent
Ikeda et al.

(10) Patent No.: US 8,483,421 B2
(45) Date of Patent: Jul. 9, 2013

(54) NARROW-ANGLE DIRECTIONAL MICROPHONE

(75) Inventors: Tatsuya Ikeda, Machida (JP); Hiroshi Akino, Machida (JP)

(73) Assignee: Kabushiki Kaisha Audio-Technica, Machida-Shi (JP)

( * ) Notice: Subject to any disclaimer, the term of this patent is extended or adjusted under 35 U.S.C. 154(b) by 0 days.

(21) Appl. No.: 13/566,310

(22) Filed: Aug. 3, 2012

(65) Prior Publication Data

US 2013/0064409 A1 Mar. 14, 2013

(30) Foreign Application Priority Data

Aug. 9, 2011 (JP) ..... 2011-173973

(51) Int. Cl.
*H04R 9/08* (2006.01)
*G10K 11/00* (2006.01)

(52) U.S. Cl.
USPC ..... 381/356; 381/357; 181/196

(58) Field of Classification Search
USPC ... 381/356–359, 368, 189, 92, 71.7; 181/158, 181/196, 242, 202
See application file for complete search history.

(56) References Cited

FOREIGN PATENT DOCUMENTS

JP 2010-245994 10/2010

*Primary Examiner* — Brian Ensey
*Assistant Examiner* — Norman Yu
(74) *Attorney, Agent, or Firm* — Manabu Kanesaka

(57) ABSTRACT

A narrow-angle directional microphone having an acoustic tube, accommodated in a cylindrical microphone case, in a circumferential wall of which an opening is formed to be covered with an acoustic resistor and to a rear end of which a microphone unit is attached, prevents abnormal noise from occurring. The narrow-angle directional microphone includes a first acoustic resisting material provided on an outer circumferential surface of the acoustic tube and covering the opening; and a second acoustic resisting material provided between the first acoustic resisting material and an inner circumferential surface of the microphone case, having a predetermined elastic force in a thickness direction. The second acoustic resisting material covers the first acoustic resisting material, and is fixed to the acoustic tube; and presses the outer circumferential surface of the acoustic tube and the inner circumferential surface of the microphone case by the elastic force.

4 Claims, 4 Drawing Sheets

PRIOR ART

PRIOR ART

NARROW-ANGLE DIRECTIONAL MICROPHONE

BACKGROUND OF THE INVENTION

1. Field of the Invention

The present invention relates to a narrow-angle directional microphone that accommodates in a cylindrical microphone case an acoustic tube, in the circumferential wall of which an opening is formed to be covered with an acoustic resistor such as non-woven fabric and to the rear end of which a microphone unit is attached, and more particularly, to a narrow-angle directional microphone that prevents abnormal noise from occurring due to the vibration from the acoustic tube and the acoustic resistor.

2. Description of Related Art

A narrow-angle directional microphone has been known which uses an elongated acoustic tube. In the narrow-angle directional microphone, a microphone unit attached to the rear end of the acoustic tube detects a sound wave input through an opening of the front end of the acoustic tube and converts the sound wave into an audio signal.

In an example of the narrow-angle directional microphone using the acoustic tube according to the related art, as illustrated in FIG. 4, an acoustic tube 50 made from a metallic tube is used, openings 51 having a slit shape are provided in the circumferential wall of the acoustic tube 50 along the central axis direction, and an acoustic resistor 52 made of e.g., a synthetic resin thin film or non-woven fabric is attached to the circumferential wall of the acoustic tube 50 to cover the openings 51.

In the narrow-angle directional microphone having the above-mentioned configuration, among the sound waves input from an opening 53 provided at the front end of the acoustic tube 50, a sound wave which turns around in the circumferential direction interferes with a sound wave which is transmitted from the openings 51 provided in the circumferential wall of the acoustic tube 50 through the acoustic resistor 52. In this way, narrow-angle directionality is realized.

JP 2010-245994 A discloses the above-mentioned narrow-angle directional microphone using the elongated acoustic tube.

However, there is a problem that when the openings 51 provided in the circumferential wall are especially large, since it is easy for the acoustic resistor 52 to make vibration, the acoustic resistor 52 makes vibration due to a sound wave with a large amplitude, unevenness is formed in a directional frequency response, and thus abnormal noise occurs.

In addition, when mechanical vibration is applied to the acoustic tube 50 and resonance occurs at a specific frequency, then abnormal noise occurs.

Further, as illustrated in a cross-sectional view in the radial direction in FIG. 5, the acoustic tube 50 is accommodated in a cylindrical microphone case 60 and used for protective purpose, but when mechanical force (vibration or impact) is applied to the microphone case 60 and the acoustic tube 50 is relatively displaced, then abnormal noise occurs.

SUMMARY OF THE INVENTION

The invention has been made in view of the above-mentioned problems and an object of the invention is to provide a narrow-angle directional microphone that accommodates in a cylindrical microphone case an acoustic tube, in the circumferential wall of which an opening is formed to be covered with an acoustic resistor and to the rear end of which a microphone unit is attached, to suppress the vibration from the acoustic resistor and the relative displacement of the acoustic tube to the microphone case and prevent abnormal noise from occurring.

In order to solve the above problems, according to an aspect of the present invention, there is provided a narrow-angle directional microphone that includes an acoustic tube, in the circumferential wall of which an opening is formed and to the rear end of which a microphone unit is connected, and a cylindrical microphone case that accommodates the acoustic tube, the narrow-angle directional microphone including: a first acoustic resisting material that is provided on the outer circumferential surface of the acoustic tube and covers the opening; and a second acoustic resisting material that is provided between the first acoustic resisting material and the inner circumferential surface of the microphone case and has a predetermined elastic force in the thickness direction, wherein the second acoustic resisting material covers the first acoustic resisting material, is fixed to the acoustic tube, and presses the outer circumferential surface of the acoustic tube and the inner circumferential surface of the microphone case by the elastic force.

An opening may be formed in the circumferential wall of the microphone case to correspond to the opening of the acoustic tube, and the second acoustic resisting material may press the edge portion of the opening in the outer circumferential surface of the acoustic tube and the edge portion of the opening in the inner circumferential surface of the microphone case by the elastic force.

In this way, in an configuration of a narrow-angle directional microphone according to the invention, the second acoustic resisting material is provided between the microphone case and the first acoustic resisting material, the second acoustic resisting material presses the first acoustic resisting material (applies stress to the inside of the radial direction) by the elastic force, and the vibration from the first acoustic resisting material is suppressed.

In addition, since the second acoustic resisting material presses the microphone case and the acoustic tube, it is possible to suppress the relative displacement between the microphone case and the acoustic tube.

In other words, since the vibration from the first acoustic resisting material and the relative displacement of the acoustic tube to the microphone case are suppressed, it is possible to prevent abnormal noise from occurring.

In addition, there may be a configuration including a metallic mesh that covers the second acoustic resisting material and is fixed to the acoustic tube, where the metallic mesh presses the inner circumferential surface of the microphone case by the elastic force of the second acoustic resisting material.

In a case where the metallic mesh is provided in this way, in assembling, when inserting the metallic mesh fixed to the acoustic tube into the microphone case, it is easy for the inner circumferential surface of the microphone case and the outer surface of the metallic mesh to slide and thus it can make assembling easy.

In addition, since the metallic mesh is located at the opening of the microphone case, it is possible to block static electricity and prevent external noise to the inside of the microphone by electrostatic coupling.

According to the invention, in a narrow-angle directional microphone that accommodates in a cylindrical microphone case an acoustic tube, in the circumferential wall of which an opening is formed to be covered with an acoustic resistor and to the rear end of which a microphone unit is attached, it is possible to suppress the vibration from the acoustic resistor and the relative displacement of the acoustic tube to the microphone case and prevent abnormal noise from occurring.

DESCRIPTION OF THE PREFERRED EMBODIMENTS

Figure 1:
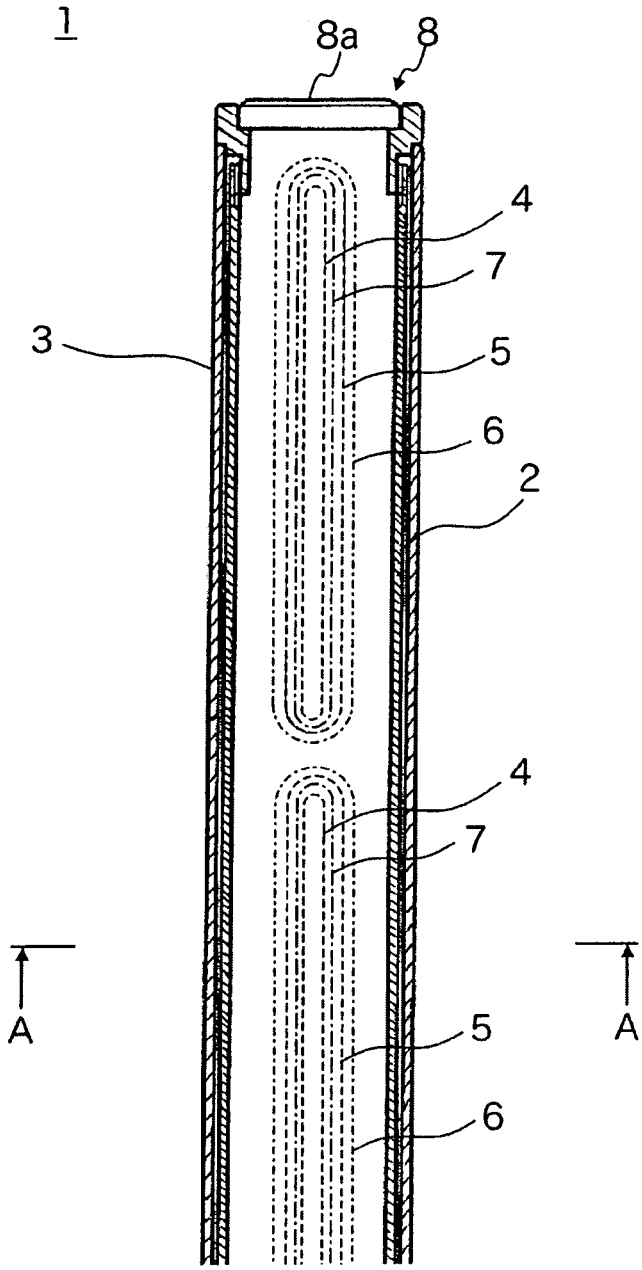
FIG. 1 illustrates a narrow-angle directional microphone according to a first embodiment of the invention and is a front cross-sectional view of main components thereof.
Figure 2:
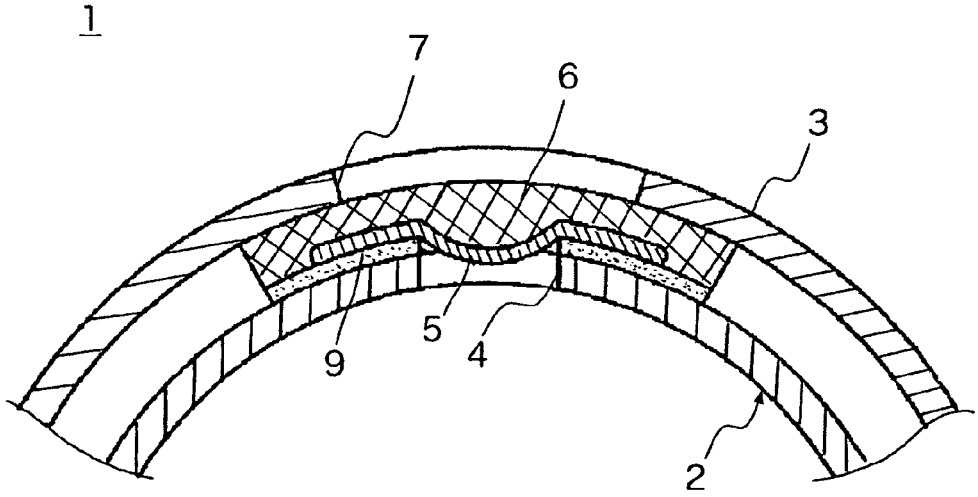
FIG. 2 is a cross-sectional view taken along the line A-A of FIG. 1 (cross-sectional view in the radial direction)

Hereinafter, embodiments of the invention will be described with reference to the accompanying drawings. FIG. 1 illustrates a narrow-angle directional microphone according to a first embodiment of the invention and is a front cross-sectional view of main components thereof. In addition, FIG. 2 is a cross-sectional view taken along the line A-A (cross-sectional view in the radial direction) of FIG. 1 and illustrates an enlarged part thereof (only the front side of FIG. 1).

A narrow-angle directional microphone 1 illustrated in FIG. 1 includes a cylindrical acoustic tube 2, to the rear end of which a microphone unit (not illustrated) is attached, and a cylindrical microphone case 3, which accommodates at least the acoustic tube 2 (the microphone unit may also be accommodated).

In addition, a plurality of openings 4 having a slit shape formed in the circumferential wall of the acoustic tube 2 along the axis direction are covered with a first acoustic resisting material 5. As illustrated in FIG. 1, the first acoustic resisting material 5 is similar to, for example, the shape of the opening 4 and is formed to be larger than the area of the opening 4. In addition, the first acoustic resisting material 5 is formed of, for example, polyester-based non-woven fabric and has a predetermined acoustic resistance.

In addition, a plurality of openings 7 are formed in the circumferential wall of the cylindrical microphone case 3 to correspond to the positions of the openings 4 of the acoustic tube 2. The openings 7 are similar to, for example, the opening 4 of the acoustic tube 2 and are open to be larger than the open area of the opening 4.

In addition, both ends of the microphone case 3 are opened and a front cover 8 with a mesh cover 8*a* on which a plurality of holes are formed is attached to the front end (upper end in FIG. 1) of the microphone case.

In addition, as illustrated in FIG. 2, at the position where the opening 4 of the acoustic tube 2 is formed (position where the openings 7 of the microphone case 3 are formed), a second acoustic resisting material 6 is provided to fill a gap between the microphone case 3 and the first acoustic resting material 5.

The second acoustic resisting material 6 has a similar shape to the first acoustic resisting material 5 as the plane shape of the second acoustic resisting material illustrates, and the second acoustic resisting material is formed to be larger than the first acoustic resisting material to cover the first acoustic resisting material 5. Specifically, as illustrated in FIG. 2, in a state of covering the first acoustic resisting material 5, the second acoustic resisting material is attached and fixed to the edge portion of the opening 4 of the acoustic tube 2 by an adhesive member 9 such as double-sided tape together with the first acoustic resisting material 5.

The second acoustic resisting material 6 is formed of, for example, polyester-based non-woven fabric, has a sufficiently low resistance value (for example, resistance value corresponding to about 1/30) compared to the resistance value of the first acoustic resisting material 5, and is designed so that a combined resistance of the first acoustic resisting material 5 and the second acoustic resisting material 6 does not become excessively large for practical purposes.

In addition, the second acoustic resisting material 6 has a predetermined elastic force in the thickness direction and presses the edge portion of the opening 7 of the inner circumferential side of the microphone case 4, the first acoustic resting material 5, and the edge portion of the opening 4 of the acoustic tube 2 by the elastic force.

In this way, in the embodiment according to the invention, the second acoustic resisting material 6 is provided between the microphone case 3 and the first acoustic resisting material 5, and the second acoustic resisting material 6 applies stress to the first acoustic resisting material 5 to the inside of the radial direction by the elastic force.

Thus, since the vibration from the first acoustic resisting material 5 is suppressed, unevenness is not formed in a directional frequency response, it is possible to prevent abnormal noise from occurring due to this.

In addition, since the second acoustic resisting material 6 presses the microphone case 3 and the acoustic tube 2, it is possible to suppress the relative displacement between the microphone case 3 and the acoustic tube 2 and prevent abnormal noise from occurring due to the vibration from the acoustic tube 2.

Figure 3:
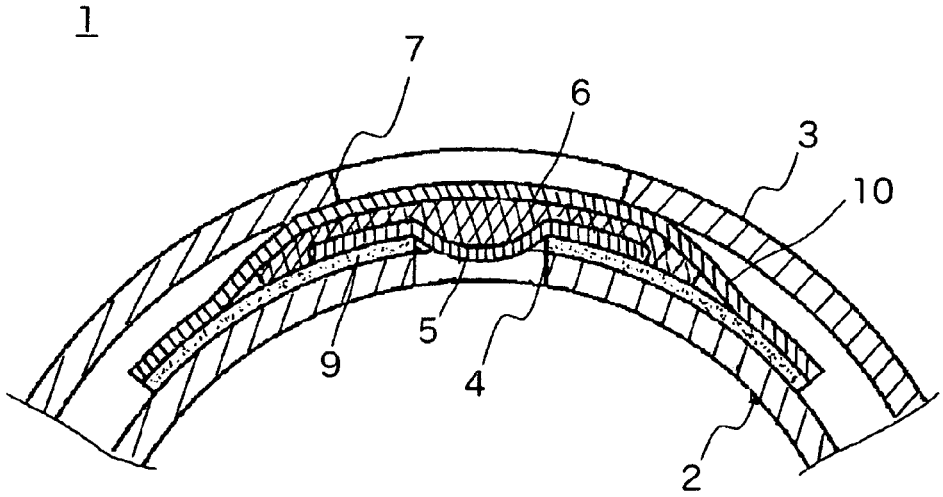
FIG. 3 is a cross-sectional view in the radial direction illustrating a variation of the narrow-angle directional microphone of FIG. 1.
Figure 4:
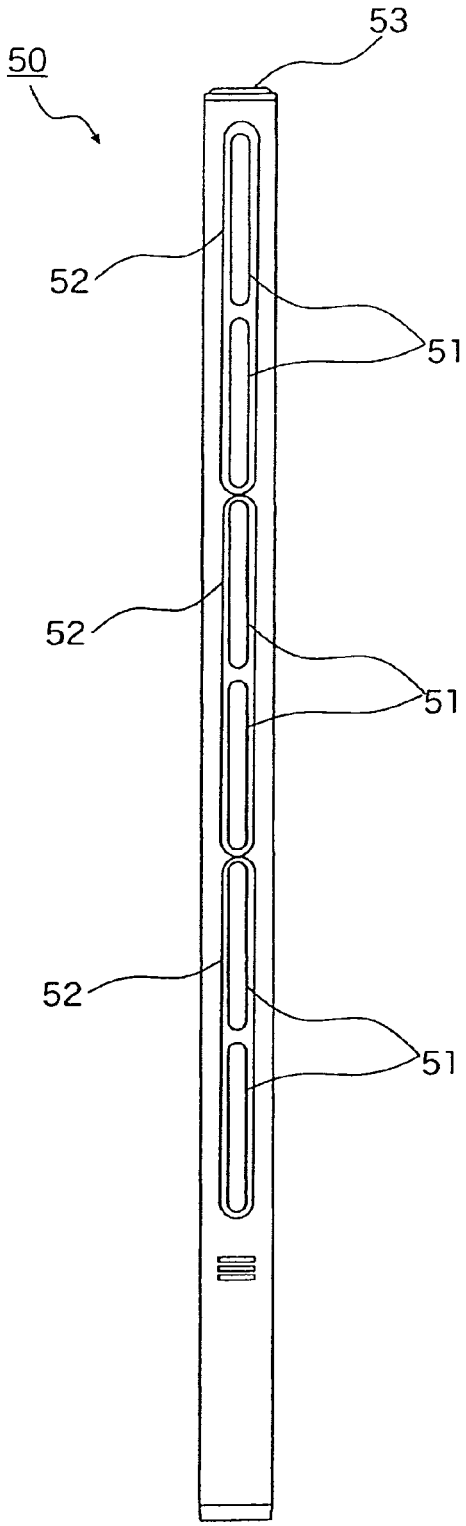
FIG. 4 is a front view illustrating the outward appearance of the narrow-angle directional microphone of the related art.
Figure 5:
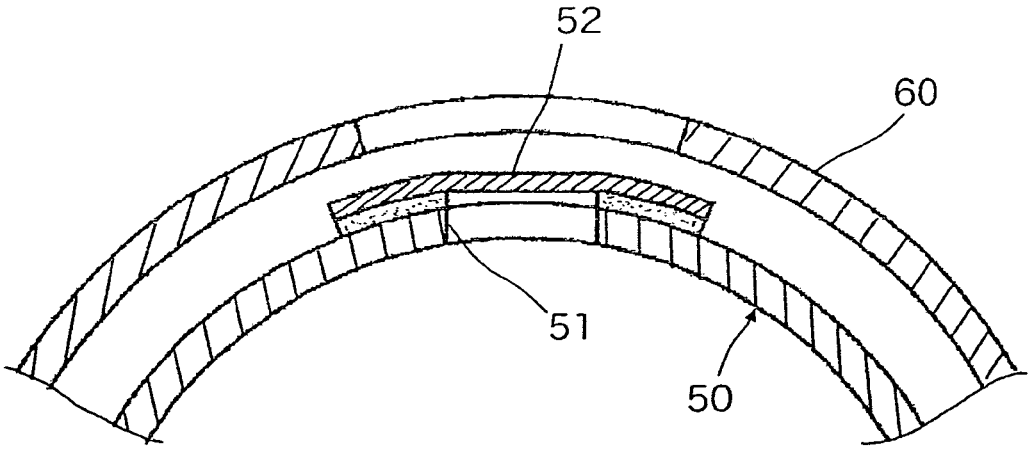
FIG. 5 is a cross-sectional view in the radial direction of the narrow-angle directional microphone of FIG. 4.

Moreover, a narrow-angle directional microphone according to the embodiment of the invention is not limited to the configuration in FIG. 2, but in the narrow-angle directional microphone, the second acoustic resisting material 6 may be covered with a metallic mesh 10, and the metallic mesh 10 may be interposed between the microphone case 3 (opening 7) and the second acoustic resisting material 6, as illustrated in FIG. 3. In this case, as illustrated in FIG. 3, the area of an adhesive member 9 is formed to be larger than when being configured in FIG. 2, and the edge of the metallic mesh 10 may adhere to the acoustic tube 2 to be fixed.

By configuring in this way, in assembling, when inserting the metallic mesh 10 fixed to the acoustic tube 2 into the microphone case 3, it is easy for the inner circumferential surface of the microphone case 3 and the outer surface of the metallic mesh 10 to slide, and thus it can make assembling easy.

In addition, since the metallic mesh 10 is located at the opening 7 of the microphone case 3, it is possible to block static electricity and prevent external noise to the inside of the microphone by electrostatic coupling.

Moreover, in this case, the metallic mesh 10 and the acoustic tube 2 may not be electrically connected through the adhesive member 9 as illustrated in FIG. 3, but by electrically connecting the metallic mesh 10 to the acoustic tube 2, it is possible to increase an effect of blocking electrostatic.

What is claimed is:

1. A narrow-angle directional microphone that includes an acoustic tube, comprising a circumferential wall in which an opening is formed and to a rear end of which a microphone unit is connected, and a cylindrical microphone case that accommodates the acoustic tube, the narrow-angle directional microphone comprising:

a first acoustic resisting material that is provided on an outer circumferential surface of the acoustic tube and covers the opening; and a second acoustic resisting material that is provided between the first acoustic resisting material and an inner circumferential surface of the microphone case and has a predetermined elastic force in the thickness direction, wherein the second acoustic resisting material covers the first acoustic resisting material, is fixed to the acoustic tube, and presses the outer circumferential surface of the acoustic tube and the inner circumferential surface of the microphone case by the elastic force.

2. The narrow-angle directional microphone according to claim 1, wherein an opening is formed in the circumferential wall of the microphone case to correspond to the opening of the acoustic tube, and the second acoustic resisting material presses the edge portion of the opening in the outer circumferential surface of the acoustic tube and the edge portion of the opening in the inner circumferential surface of the microphone case by the elastic force.

3. The narrow-angle directional microphone according to claim 1, comprising a metallic mesh that covers the second acoustic resisting material and is fixed to the acoustic tube, wherein the metallic mesh presses the inner circumferential surface of the microphone case by the elastic force of the second acoustic resisting material.

4. The narrow-angle directional microphone according to claim 2, comprising a metallic mesh that covers the second acoustic resisting material and is fixed to the acoustic tube, wherein the metallic mesh presses the inner circumferential surface of the microphone case by the elastic force of the second acoustic resisting material.

* * * * *